United States Patent [19]

Martin

[11] 4,280,250

[45] Jul. 28, 1981

[54] TEXTILE CARDING MACHINE FRAME CONSTRUCTION

[75] Inventor: Graham Martin, Bolton, England

[73] Assignee: Platt Saco Lowell Limited, England

[21] Appl. No.: 61,550

[22] Filed: Jul. 26, 1979

[51] Int. Cl.[3] ..... D01G 15/32
[52] U.S. Cl. ..... 19/98
[58] Field of Search ..... 19/98, 99

[56] References Cited

U.S. PATENT DOCUMENTS 2,912,721 11/1959 Müllenschläder ..... 19/99
3,308,511 3/1967 Culpan ..... 19/98 X

FOREIGN PATENT DOCUMENTS 936524 9/1963 United Kingdom ..... 19/98

*Primary Examiner*—Louis Rimrodt
*Attorney, Agent, or Firm*—Donald H. Feldman

[57] ABSTRACT

A carding machine for textile material has a taker-in cylinder, a main cylinder and a doffing cylinder supported by a frame comprising of two frame side members. The frame side members are constructed from sheet steel and are interconnected by two sheet steel cross-members of hollow cross section the ends of which are welded to the inwardly facing surfaces of the frame side members.

Preferably, the frame further includes a base member welded along the bottom of the inwardly facing surfaces of the frame side members.

13 Claims, 4 Drawing Figures

TEXTILE CARDING MACHINE FRAME CONSTRUCTION

FIELD OF THE INVENTION

The present invention relates to machines for carding textile fibres, and more particularly to the frame construction for such machines.

DESCRIPTION OF THE PRIOR ART

Carding machines conventionally include two frame sides supporting a taker-in cylinder, a main cylinder and a doffing cylinder with respective driving arrangements and ancilliary equipment. Previous carding machine frames have been of cast iron construction with the cast iron side frames secured and positioned by a number of cross rails bolted to the inside surfaces of the frame sides. This method of construction is expensive in that, for every cast component, a mould must be prepared and, after moulding, it is necessary to machine flat mounting surfaces for the cylinder bearing assemblies. Frames of this type, being constructed of separate units bolted together, also lack rigidity and when the carding machine is in operation some movement between adjacent unit parts usually occurs. This leads to the disadvantage that it is not possible to maintain accurate settings between the surfaces of the cylinders and particularly between the taker-in and main cylinder where the clearance is small. A disadvantage also arises in that it is difficult, or impossible, with conventional frame arrangements to transport a carding machine in assembled form. Another disadvantage arises in a machine of the above type in that the aforementioned cross rails and other protruberances, inherent on the cast part of the frame, form obstacles to the efficient removal of dust, short fibres and waste material from the confines of the machine frame beneath the taker-in, main cylinder and doffing cylinder. This waste material drops beneath these cylinders and is usually removed by a pneumatic undercard cleaning system which in one known arrangement, blows dust and waste under the doffer along the floor of the card and collects it beneath the taker-in region. The cross rails and protruberances mentioned above snag the waste and this can cause an excessive build up of waste material beneath the carding cylinder.

A carding machine frame has been proposed constructed from angle iron and rolled steel plate for the frame sides which are interconnected by plates and tie rods of small cross section. This is shown in British Pat. No. 1 058 246. This structure however, as disclosed in the above patent, is not sufficiently free from snagging protruberances and does not provide the machine with the amount of rigidity required for satisfactory running of the machine.

British Pat. No. 1 169 741 shows a machine frame arrangement wherein an attempt to overcome the problem of rigidity and relative movement between the cylinders has been made by mounting the cylinders on a subframe which is freely pivotable relative to supporting members so that torsional movements of the frame as a whole are taken up in the pivots without interfering with the relative positions of the cylinders. However this solution has not been entirely satisfactory and has recently been abandoned.

SUMMARY OF THE INVENTION

According to the invention there is provided a carding machine comprising a taker-in cylinder, a main cylinder and a doffing cylinder and including a frame for supporting said cylinders and comprising two longitudinally extending frame side members laterally spaced from each other, each of the frame side members being constructed from sheet steel and having a substantially flat surface facing inwardly and an upper surface for supporting at least one of the cylinders, the frame further comprising two sheet steel cross members of hollow cross section each of which interconnects the two frame side members and has its two ends welded to the inwardly facing flat surface of the respective frame side member.

The machine frame comprises five main component parts, a base member 1, frame sides 4 and 5, and hollow cross members 6 and 7.

Figure 2:
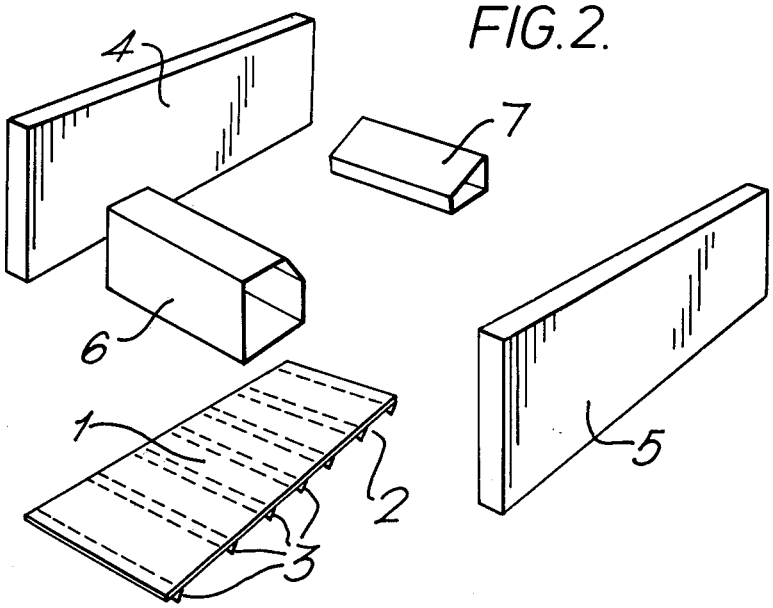
FIG. 2 is an exploded view of the component parts of the carding machine frame of FIG. 1, prior to assembly and welding.

The base member 1 comprises a rolled steel plate or sheet 2, which is cut to size by a power guillotine, and stiffening members 3, which are cut to size in a similar manner. The stiffening members 3 are formed to a 'V' section as shown in FIG. 2. The base member 1 is then assembled by positioning the stiffening members 3 on the plate 2 in an assembly jig and then welded to the plate 2, thus strengthening the base member.

Figure 3:
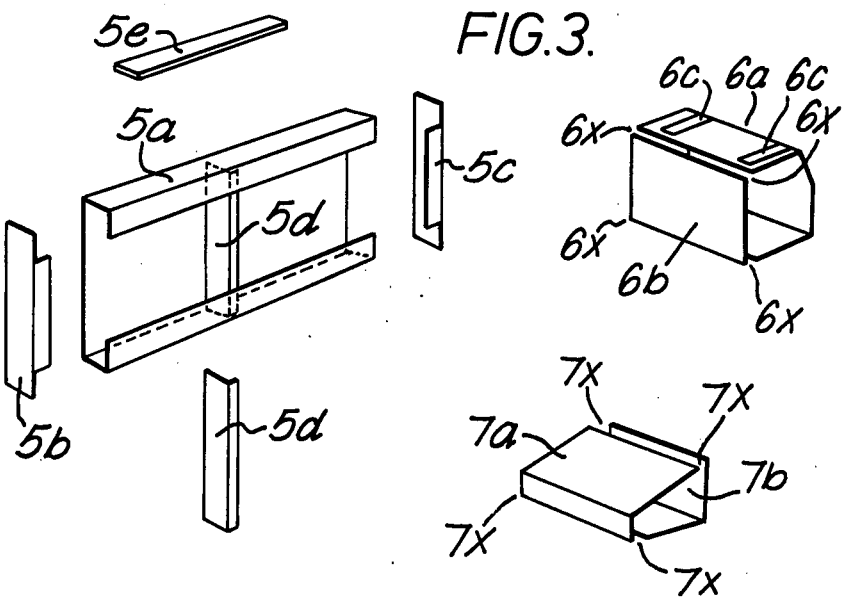
FIG. 3 is an exploded view of the component parts of the frame shown in FIG. 2.

The frame side members 4 and 5 are cut to size from rolled steel plate or sheet and apertures for mounting various components and assemblies are cut. This cutting operation is performed by a punched tape controlled automatic cutting machine which cuts or nibbles out apertures of pre-determined size and shape in response to signals obtained from the punched tape. The apertures are de-burred and the flat sheet is than formed by a press brake or similar banding machine to the shape as shown in FIG. 3. The frame side 5 comprises of a side plate 5*a*, two end plates 5*b*, 5*c*, a plurality of stiffening members 5*d* and a mounting pad 5*e*. The side plate 5*a* comprises a flat sheet with the top and bottom edges folded to form a surface at right angles to the sheet and then folded to form a flange along the top and bottom edges parallel to the flat sheet. The two end plates 5*b* and 5*c* are cut and formed as shown in FIG. 3 with a flat face and a portion extending at right angles thereto. These are assembled with the side plate 5*a* and electric welded in position so that the flat face of the end plate 5*b* forms an end face for the frame side members and the edges of the extending portion are welded in position to form a continuous flange parallel to the flat sheet. The side stiffeners 5*d* are then cut to size and formed to the shape as shown in FIG. 3. Six side stiffeners are used in each of the frame side members 4 and 5 and after forming are positioned as shown in the general drawing of FIG. 1 with five disposed vertically and one indicated at 5*f*, at approximately 60° to the vertical and electric welded or spot welded into position. A mounting pad 5*a* is then affixed to the frame side 5 by welding. The frame side 4 is fabricated in the same manner.

The cross member 6, which is made in two parts 6*a* and 6*b*, is cut to size in the aforementioned manner and part 6*a* is formed as shown in FIG. 3, assembled with part 6*b* and electric welded along the two longitudinal seams 6*X* to form a hollow cross member of substantially rectangular box cross-section with one of its corners chamfered. Steel pads 6*c* are then welded in position. The cross-member 7, which is also made in two parts 7*a* and 7*b*, is cut to size then formed as shown in FIG. 3. The two parts 7*a* and 7*b* are then assembled and electric welded along the longitudinal seams 7*X* to form a similar box section to member 6 with the main difference that the chamfered corner has a smaller angle of inclination with respect to the horizontal. After the above five main component parts of the machine frame have been manufactured the welds are de-scaled and dressed and assembled in a frame assembly jig which locates the parts shown in block diagram in FIG. 2. On being positioned the base member 1 is welded to the frame sides 4 and 5. The edge of the cross members 6, 7 are welded in position to the inwardly facing surfaces of the frame side members 4, 5. The welds are then descaled and dressed to maintain a smooth finish and prevent the formation of snagging surfaces. After these operations have been carried out the whole fabricated structure is subjected to a stress relieving process which releases the stresses caused by the welding process. The pads 4*e* and 5*e* are provided for mounting the cylinder bearing assemblies and they are therefore machined by planing or surface grinding to form a flat surface. A pair of pads 6*c* are similarly treated after being welded into position by planing or surface grinding. These pads are used for mounting the feed plate assembly (not shown) on the carding machine.

Figure 4:
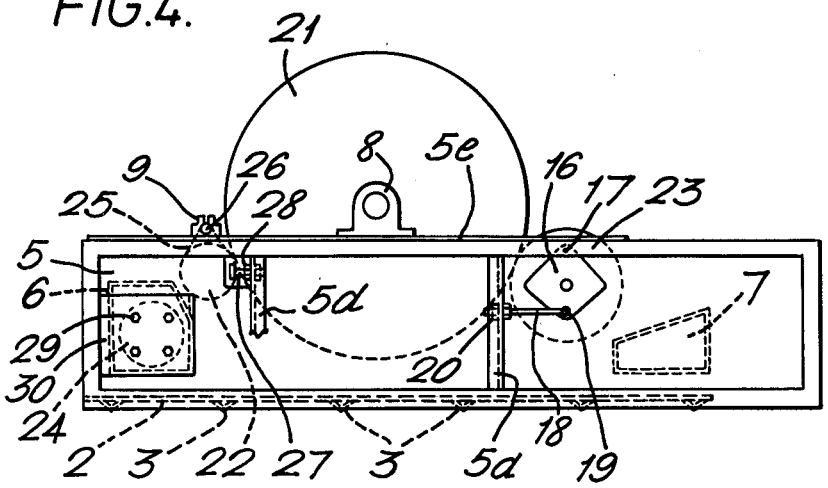
FIG. 4 is a side elevation of the carding machine frame including the taker-in, main cylinder and doffing cylinder.

Referring to FIG. 4 of the drawings the machine frame is shown with a taker-in cylinder 22, a main cylinder 21 and a doffing cylinder 23 mounted in position. The specific details of construction of the frame side member 5 (illustrated) have been omitted for clarity.

On the frame sides members 4 and 5 (frame side 5 shown) the main cylinder 21 is mounted for rotation in a pair of bearings 8 (one shown) which are positioned on the mounting pads 4*e* and 5*e*. The taker-in cylinder 22 is pivotally mounted beneath the upper surfaces of the frame sides 4, 5. The cylinder 22 is rotatably supported at each end in a subframe 25 each of which is pivotal on a pivot shaft 26 mounted in bearings 9. Connected to each subframe 25 is a screwed rod 27 which is fixed to a stiffener 5*d* by a nut and locknut 28. Adjustment of the clearance between the taker-in cylinder 22 and the main cylinder 21 is thereby attained by loosening the nut and locknut 28, pivotting the subframe 25 until the desired clearance is obtained, and then screwing the nut and locknut 28 against the stiffening member 5*d*.

The doffing cylinder 23 is mounted below the upper surfaces of the frame side members in an underslung position by a pair of subframes 16 each one of which supports a respective and of the axle (not shown) of the doffing cylinder 23 for rotation and each of which is pivotable about a pivot shaft 17 fixed to the side member. Adjustment of the doffer 23 in relation to the main cylinder 21 is by a pair of screwed rods 18 each of which is pivoted at 19 and secured to a respective frame stiffener 5d by a nut and locknut 20.

Locating the rotational axes of the taker-in cylinder and the doffing cylinder below the upper surfaces of the frame side member 3 assists in achieving stability of the frame during operation.

A drive motor 24 for the main cylinder 21 is mounted by bolts 29 to a plate 30 fixed to a side frame member 5. The plate 30 lies in the same plane as the side frame flange so that part of the motor 24 protrudes into the inside of the hollow crossmember 6 and thereby reduces the space taken up within the frame.

Figure 1:
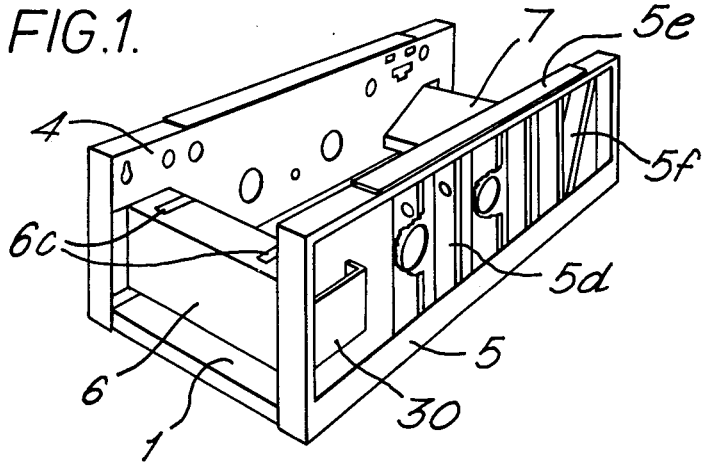
FIG. 1 is a perspective view of the machine frame of a carding machine according to the invention.

The carding machine frame of the above embodiment has the advantage of increased rigidity over previously known frames. The fabricated structure as described above and its construction as shown particularly in FIGS. 1, 2 and 3 give great rigidity.

This allows the machine to be transported in assembled condition and may give increased periods of operation before re-setting of the working clearances is necesary. Additionally, the frame is free from protruberances and traps for fibres and trash, thus preventing accumulation of fibres. As seen in FIG. 1, the cross member 6 extends between the side frame members 4, 5 in the vicinity of the taker-in cylinder 22. The chamfered corner of the cross member 6 adjacent to this cylinder provides a downwardly inclined surface so as to encourage waste fibres and trash to slide off for removal by an under card cleaning system. Similarly, the cross member 7 extends between the side frame members 4, 5 in the vicinity of the doffing cylinder 23. The corner adjacent to this cylinder provides a downwardly inclined surfaces so as to encourage waste fibres and trash to slide off for removal by the under card cleaning system.

I claim:

1. A carding machine for textile fibres comprising a taker-in cylinder, a main cylinder and a doffing cylinder, and including a frame for supporting said cylinders and comprising two longitudinally extending frame side members laterally spaced from each other, each of the frame side members being constructed from sheet steel and having a substantially flat surface facing inwardly and an upper surface for supporting at least one of the cylinders, the frame further comprising two sheet steel cross members of hollow cross section each of which interconnects the two frame side members and has its two ends welded to the inwardly facing flat surface of the respective frame side member.

2. A carding machine as claimed in claim 1, wherein each frame side member comprises a substantially flat sheet steel facing inwardly, a top edge having a portion turned outwardly at right angles to the sheet to form the upper surface and a flange extending parallel to the sheet, and a bottom edge having a portion turned outwardly at right angles to the sheet and a flange extending parallel to the sheet.

3. A carding machine as claimed in claim 2, wherein each frame side member includes a plurality of stiffening sheets extending transversely to the length thereof.

4. A carding machine as claimed in claim 3, wherein the cross members are substantially rectangular in cross-section one of which extends between the side frame members in the vicinity of the taker-in cylinder and the other of which extends between the side frame members in the vicinity of the doffing cylinder each of the cross members having a corner adjacent the cylinders chamfered to provide an inclined surface from which fibres and trash slide to prevent accumulation thereof.

5. A carding machine according to claim 1 wherein the frame further includes a base sheet welded to the bottom of the inwardly facing surfaces of the frame side members along the length thereof.

6. A carding machine as claimed in claim 5, wherein the base sheet includes stiffening members extending transversely to the length thereof.

7. A carding machine according to claim 1, wherein each frame side member includes a mounting pad which is machined to provide a flat surface on the upper surface thereof for supporting the main cylinder.

8. A carding machine according to claim 1, wherein a motor is housed in one of the cross members.

9. A carding machine for textile fibers comprising a taker-in cylinder, a main cylinder and a doffing cylinder, a frame for supporting said cylinders including two longitudinally extending frame side members laterally spaced from each other, each of the frame side members being formed of sheet steel and having a substantially flat inwardly facing surface and an upper surface for supporting at least one of the cylinders, the frame further comprising two sheet steel cross members of hollow cross section the two ends of each of which cross members are welded to the respective inwardly facing flat surfaces of the frame side members, and wherein the doffing cylinder is supported at each end for rotation in a pivotally mounted sub-frame.

10. A carding machine as claimed in claim 9, wherein each of the sub-frames is pivotally mounted on a pivot shaft supported by the frame side member, sub-frame adjusting means comprising an adjustable rod having one end attached to a sub-frame and the other end attached to the side frame member, whereby movement of the rod effects pivotal movement of the doffing cylinder about the pivot shaft so that the clearance between the doffing cylinder and the main cylinder can be adjusted.

11. A carding machine for textile fibers comprising a taker-in cylinder, a main cylinder and a doffing cylinder, a frame for supporting said cylinders including two longitudinally extending frame side members laterally spaced from each other, each of the frame side members being formed of sheet steel and having a substantially flat inwardly facing surface and an upper surface for supporting at least one of the cylinders, the frame further comprising two sheet steel cross members of hollow cross section the two ends of each of which cross members are welded to the respective inwardly facing flat surfaces of the frame side members, and wherein the taker-in cylinder is supported at each end for rotation in a pivotally mounted sub-frame.

12. A carding machine as claimed in claim 11, wherein each sub-frame is pivotally mounted on a pivot shaft supported by the side frame member, sub-frame adjusting means comprising an adjustable rod having one end attached to a sub-frame and the other end attached to the side frame member, whereby movement of the rod effects pivotal movement of the taker-in cylinder about the pivot shaft so that the clearance between the taker-in cylinder and the main cylinder can be adjusted.

13. A carding machine according to claims 9 or 11, wherein the rotatinal axes of the taker-in cylinder and the doffing cylinder are below the upper surface of the frame side members.

* * * * *